United States Patent [19]

Wimberley

[11] Patent Number: 4,789,124

[45] Date of Patent: Dec. 6, 1988

[54] CONTINUOUS-SHEET PAPER HOLDER

[76] Inventor: Amos D. Wimberley, 3902 Sycamore, Austin, Tex. 78722

[21] Appl. No.: 79,035

[22] Filed: Jul. 29, 1987

[51] Int. Cl.[4] ..... A47B 65/00

[52] U.S. Cl. ..... 248/463; 281/42; 282/29 R

[58] Field of Search ..... 248/441.1, 451, 452, 248/453, 455, 463; 211/45, 50; 281/42; 40/341, 352; 282/29 R, 29 A, 29 B

[56] References Cited

U.S. PATENT DOCUMENTS

| | | | |
|---|---|---|---|
| 409,340 | 8/1889 | Unz | 248/441.1 |
| 530,806 | 12/1894 | Tilton | 282/29 R |
| 647,517 | 4/1900 | Pike | 248/453 |
| 1,025,744 | 5/1912 | Houghton | 282/29 B |
| 1,086,746 | 2/1914 | Babbitt | 211/45 |
| 1,231,926 | 7/1917 | McKinley | 40/352 |
| 1,568,425 | 1/1926 | Smith | 248/451 |
| 1,817,640 | 8/1931 | Newman | 40/352 |
| 2,193,991 | 3/1940 | Treacy | 248/453 |
| 2,322,259 | 6/1943 | Thurston | 40/352 |
| 2,635,608 | 4/1953 | Shepherd | 282/29 B |
| 3,222,087 | 12/1965 | Keenan | 282/29 A |
| 3,799,488 | 3/1974 | Sena | 248/460 |
| 4,502,658 | 3/1985 | Wirt | 248/452 |
| 4,531,642 | 6/1985 | Racich | 248/451 |
| 4,555,084 | 11/1985 | Anderson | 248/455 |
| 4,603,883 | 8/1986 | Barbieri | 248/451 |

*Primary Examiner*—Ramon O. Ramirez
*Assistant Examiner*—Robert A. Olson
*Attorney, Agent, or Firm*—Richard C. Litman

[57] ABSTRACT

An apparatus for reading, transporting or storing continuous, fanfold paper includes a base member adapted to support mulitple stacks of joined pages of paper with separate elements engaging the lower edges of each stack of paper. Upstanding elements on the base member engage pin feed holes of each stack to provide additional stability retaining the stacks in place while permitting ready turning of the pages from one stack to the other. The base may be integral or comprise two sections with alternate construction permitting attachment and separation thereof.

8 Claims, 2 Drawing Sheets

CONTINUOUS-SHEET PAPER HOLDER

FIELD OF THE INVENTION

This invention relates generally to a stationery accessory, and more particularly, to an improved copyholder device especially adapted to accommodate continuous, fanfold paper stock.

BACKGROUND OF THE INVENTION

With the proliferation of computers and fast-speed printers, many persons find themselves handling documents printed on continuous-sheet, fanfold paper, most commonly referred to as computer paper. Stationery devices such as binders have long been utilized to retain printouts produced on computer paper. Many of these binder devices use clamping mechanisms or fastener members adapted to penetrate the paper pin feed holes, to hold the stack of folded sheets in the binder. For a user to read pages contained in these binders it is usually necessary to have initially burst the pages at the horizontal perforations, or tearlines, so as to separate the pages and allow the user to flip or turn them. Additionally, it is often necessary to provide punch holes along the top edge of all the pages in order to 9 receive metal or plastic fastener devices.

DESCRIPTION OF THE PRIOR ART

Various prior art paper handling devices and like, as well ass the apparatus and method of their construction in general, are known and are found to be exemplary of the U.S. prior art. They are:

| U.S. Pat. No. | Inventor |
|---|---|
| 1,523,136 | J. B. O'Connor |
| 1,787,387 | C. Marz |
| 2,137,748 | L. H. Best |
| 2,470,347 | R. L. Gallagher |
| 2,700,464 | L. O. Ostnas et al |
| 3,092,379 | J. R. Collier |
| 4,499,128 | M. A. Strausheim |

U.S. Pat. No. 1,523,136 discloses a sheet metal receptacle of the type frequently referred to as a tool tray and comprises a box-like structure opened at the top With side strips secured to the sides.

U.S. Pat. No. 1,787,367 discloses a paper-sorting device and, more particularly, a device that consists of several superimposed containers. It consists of a base container upon which two other containers rest, all three containers being hinged together.

U.S. Pat. No. 2,137,748 discloses a display stand comprising a bed that is supported by legs both in the front and rear of the bed and includes a pair of oppositely disposed flanges.

U.S. Pat. No. 2,470,347 is directed to a letter tray for lifting the ends of paper for easy grasping and includes a rectangular member of box-like shape having an open end pivoted on cylindrical extensions.

U.S. Pat. No. 2,700,464 concerns a device for removing paper sheets from drawers and includes a sheet-elevating member and buckle or other slidable fastening device.

U.S. Pat. No. 3,092,379 discloses a device for folding sheets of paper and the like, comprising a substantially rectangular flat base, an abutment member and a pair of vertical members.

U.S. Pat. No. 4,499,128 is directed to an adjustable divider strip mounting for plastic trays and includes a flat rectangular tray and divider strips.

These patents or known prior devices teach and disclose various types of handling devices and more particularly, paper handling devices. However, none of the above discloses means for handling continuous, fanfold paper such as presented by the present apparatus. Also, none of these known arrangements suggest the specific details of the instant construction, whether considered singly or in any combination, in such a Way as to bear upon the claims as appended hereto.

SUMMARY OF THE INVENTION

By the present invention, an improved paper handling device is presented for retaining a stack of several pages of continuous fanfolded paper in a convenient disposition whereby the stack may be easily transported With the paper remaining intact. A construction is provided for stabilizing fanfold paper on the device including an upstanding ridge or fence engageable with the existing tear lines or horizontal perforation lines of the stacked, joined pages. Additionally, elements are provided adjacent the sides of the device for engagement with the lateral edges of the paper stock such that two adjacent open pages of the stock are maintained in a position conducive to ready reading by the user. In this manner, the device may be held by hand, disposed upon any suitable supporting surface such as a desktop, or easily stored or transported between locations. In support of the latter use, the device may be constructed to allow for its folding or rearrangement.

Accordingly, one of the objects of the present invention is to provide an improved fanfold paper handling device including a base member having two coplanar page supporting surfaces substantially bisected by an elevated fence adapted to engage the break or tearline between adjacent pages straddling the fence and to support an uppermost stack thereon.

Another object of the present invention is to provide an improved fanfold paper handling device mountable at a convenient reading angle and including a plurality of containment elements engageable by the lateral edges of two separate but attached stacks of paper to stabilize the stacks and allow the paper to be maintained at an elevated angle.

Still another object of the present invention is to provide an improved continuous, fanfold paper handling device allowing the supporting of, while permitting the turning of, successive connected pages upon an underlying support which may be used as a portable desk, clipboard or the like.

A further object of the present invention is to provide an improved fanfold paper handling device including a support base having two sections each adapted to support one or more pages of fanfold paper and Wherein the two sections may be displaceably joined together to permit shifting from alternate reading, to transport or storage modes.

These and other objects and advantages of the invention, reside in the details of the process and the operation thereof, as more fully hereinafter described and claimed. Reference is made to the drawings forming a part hereof wherein, similar reference characters refer to like parts throughout.

DESCRIPTION OF THE PREFERRED EMBODIMENTS

Figure 1:
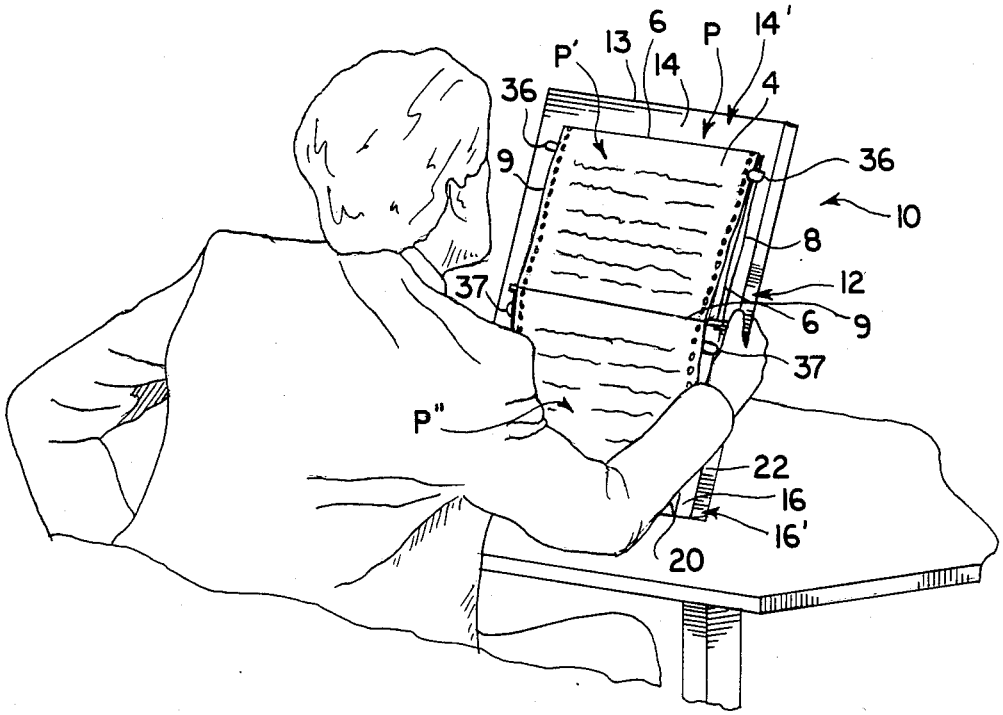
FIG. 1 is a perspective view of one embodiment of the invention as utilized in a reading position.

Referring now to the drawings, the paper handling device of the invention will be understood to permit the mounting, carrying, manipulation, and storage of a variable number of sheets of continuous, fanfold paper such as that commonly referred to as computer printout paper, identified generally as P in the drawings. Such paper is well known and includes a plurality of individual sheets or pages 4 joined together along fold-crease or tearlines 6 comprising minute perforations allowing the user to separate the sheets if desired, a process known as bursting. As is well known in the art, such paper includes a plurality of equispaced holes 8 along the lateral edges 9-9 and which serve to cooperate With the pinfeed mechanism of printers or tractor feeders. The existence of these holes has no effort upon utilization of the instant device.

It Will be appreciated that the present copyholder or paper handling apparatus may be employed with continuous paper of any known dimensions, by providing the structure thereof, of various configurations. Thus, by providing the device in two different widths, the two most popular sizes of the paper may be accommodated.

The device of this invention proposes to allow manipulation of a stack of intact pages 4 in an improved manner to permit a user to more efficiently read, manipulate, store and transport such a stack in an orderly fashion.

Figure 2:
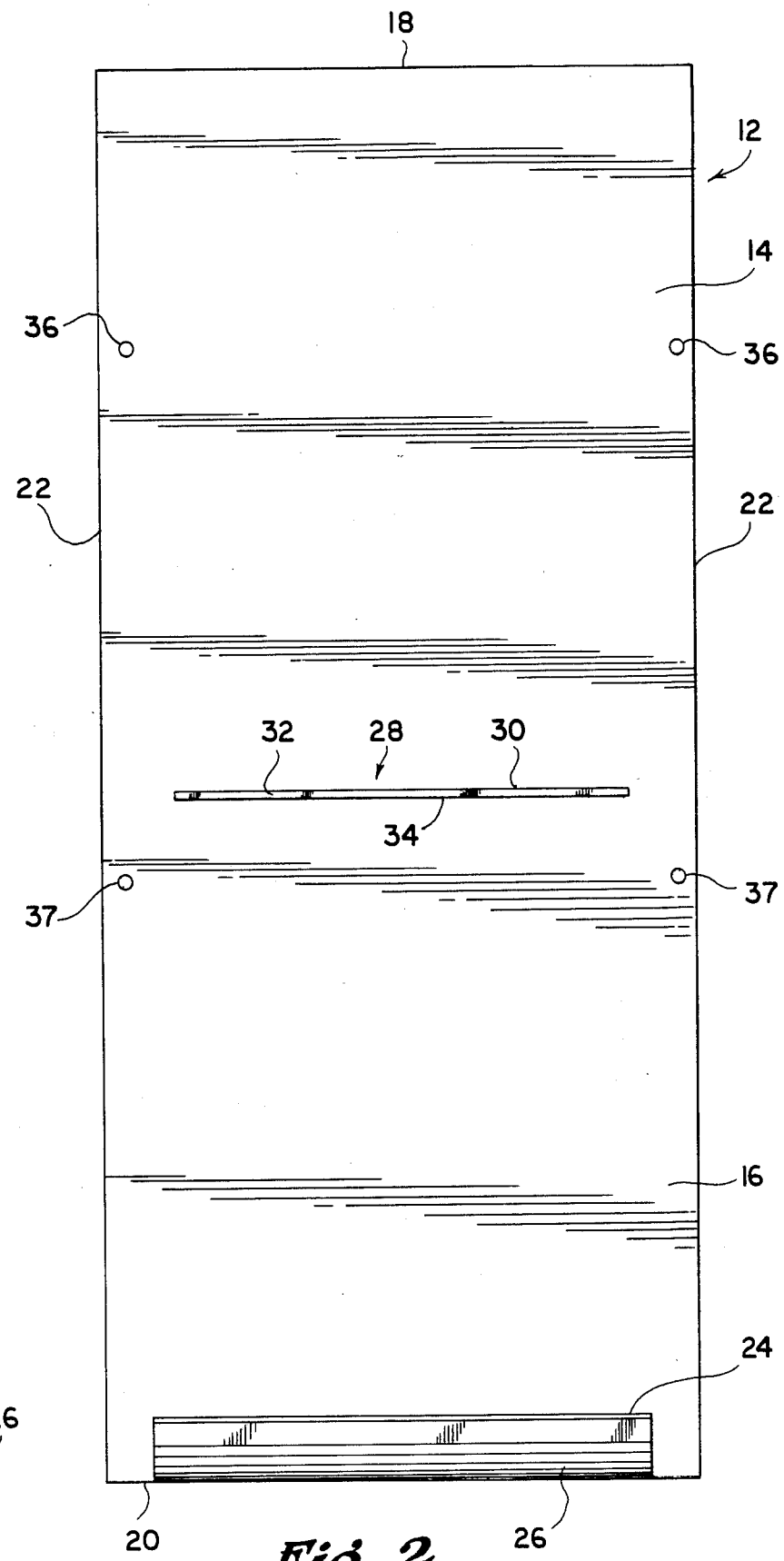
FIG. 2 is a front view of the device of FIG. 1 with the paper removed for purposes of clarity.

The device 10 as illustrated in FIG. 1 of the drawings includes a base 12 of rigid material and which provides an upper supporting surface 14 adjacent a bottom section 16' defining a lower supporting surface 16 such as shown in FIG 2. These two surfaces are preferably coplanar and when the device is intended to be utilized primarily as a clipboard or a copyholder without regard to compact transport of the continuous paper, the base 12 may be constructed to provide a one-piece or integral member such as in the illustrations of FIGS. 1 and 2. In all of the various embodiments described herein it will be understood that features shown in one alternative may be combined to arrive at other alternatives without departing from the scope of the invention.

The base 12 includes a top 18, bottom 20 and opposite sides 22—22 preferably defining a rectangular configuration and which is dimensioned so as to fully accommodate the bounds of the desired paper stock to be used, atop the supporting surfaces 14, 16. Thus, two different sizes of the device may be provided to utilize it with the two most common sizes of computer paper so that an upper stack P' and an adjacent, connected lower stack P'' may be disposed upon the device as in FIG. 1 of the drawings. It will be seen in FIG. 1 that the width of the base 12, between the sides 22—22, is greater than the paper width for reasons to be described later on.

To initially utilize the device 10, such as for a clipboard or copyholder, a stack of continuous, fanfold paper P'' is disposed atop the lower base supporting surface 16 with the lower folds or tearlines 6 of this stack resting upon the shelf or flange 24 attached adjacent the bottom 20 of the base 12. This shelf 24 projects upwardly or normal relative the lower supporting surface 16 and may be affixed to the base such as by the mounting flange 26. The base will be seen also to include an upstanding fence 28 extending transversely of the base along its medial area. This fence 28 is provided with an upper ledge or shelf 30 facing toward the base top 8 and which terminates in a top-most or outer edge 32, the purpose of which will become apparent hereinafter.

The fence 28 is vertically positioned such that its undersurface 34 is spaced from the bottom support shelf 24 a distance only slightly greater than the vertical length of individual sheets 4 of the paper stock, e.g. 11 inches. By this it is meant that a stack P'' is easily deposited or removed between the opposed surfaces of the ledge 24 and fence undersurface 34 without any binding yet with clearance adjacent the top and bottom fold on tearlines 6 of the stack P''. In this manner, it will be seen that when any page or connected pages of paper are folded upwardly from the lower stack P'', into the area of the upper stack P', the common tearline 6 joining the two stacks P' and P'' will overlie the top edge 32 of the fence 28 while the bottom edges or tearlines 6 will have a portion of the underlying pages in the lower stack P' that will rest upon the lower ledge 30 of the fence 28.

Even more importantly, it will be understood that the tearline 6 of every adjacent pair of sheets in the upper stack P', beneath the topmost page 4, will automatically be disposed in a supporting manner upon the upper ledge 30 of the fence 28. The weight and co-efficient of friction between the stacked page 4 of stack P' provide mechanical stability for the sheets of paper with the fence 28 engaged against a lower portion thereof.

With the above described arrangement it will be appreciated that positive means are thus provided to maintain definite separation between the two individually supported stacks P' and P'' whereupon pairs of joined pages from either stack may be readily turned up or down between the stacks to reveal the contents thereon to the user. The number of folded pages 4 or thickness of either stack P' or P'' is not limited to the height of the shelf 24 or fence 28. Experience has shown that either stack may be substantially thicker than the height of the upstanding members 24, 28 since the engagement by several tearlines 6 upon these members provides sufficient support to retain many more folded pages even though these latter pages are disposed at levels higher than the shelf or fence.

To offer additional stabilization to the supported paper stock, pairs of upstanding pins 36–37 are provided on both the upper and lower supporting surfaces of the base 12. These pins 36–37 are located adjacent the two sides 22 of the base, With opposed pairs being spaced apart a distance slightly greater than that of the pin width of the paper stock being used with the device. The upper two pins 36 are preferably above the medial area of the upper supporting surface 14 while the lower two pins 37 will be seen to be disposed on the lower surface 16, adjacent the fence 28.

With the foregoing arrangement, the lower stack P'' is laterally stabilized as the two pins 37—37 serve as abutment members adjacent the lateral 9—9 edges of the pages therein while the upper stack P′ is likewise positively retained in place by the two pins 36—36 adjacent thereto.

Figure 3:
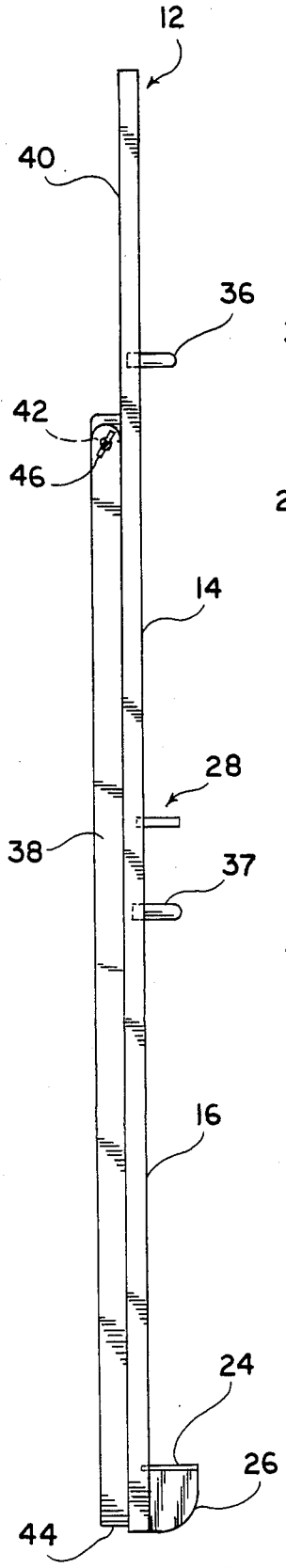
FIG. 3 is a side elevation of the structure of FIG. 2.

As thus described, the device 10 may serve as a clipboard to permit ready storage, reading, manipulation or transport of continuous, fanfold paper, with subsequent pages of either stack P′–P″ being quickly accessible to the user by simply folding down or up, the desired number of pairs of connected pages with retention assured by means of pins 36 and 37, such pins or posts not interfering in any manner with the paper manipulation. Used in a clipboard mode, the device may obviously be hand-held in any suitable position, including face down, such as in FIG. 1. Alternatively, the device may be provided with suitable means to prop same relative a supporting surface, in order to allow a hands-free use. FIG. 3 of the drawings illustrates the inclusion of such means comprising one or more legs 38 which may be pivotally attached to the rear 40 of the base 12, as at 42, and Which include a foot 44. With this construction, the leg or legs 38 may be moved from the storage position of FIG. 3 to any desired angular position and then secured, such as by a suitable fastener 46, to facilitate use of the device as a free-standing copyholder.

Figure 4:
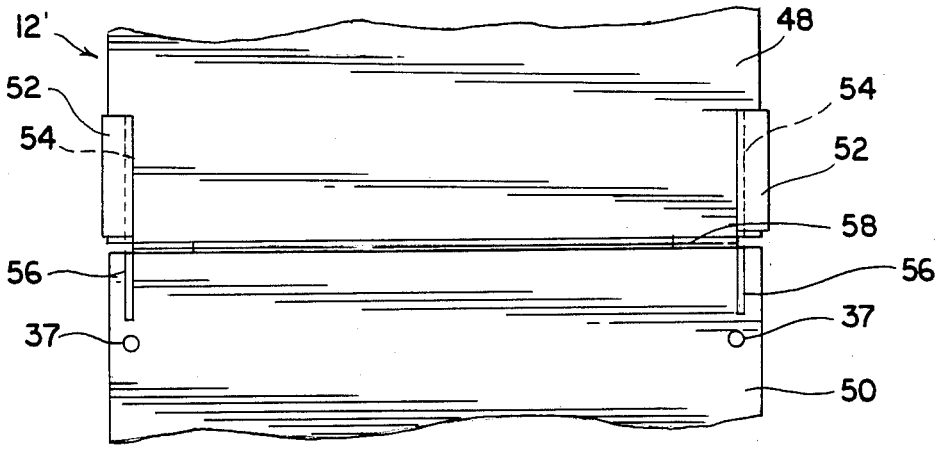
FIGS. 4 and 5 are partial plan views illustrating alternative interlocking joints permitting disassembly of a two-art paper support board.

As described up to this point, the base 12 comprises a unitary member. However, alternate embodiments may be provided Wherein the upper and lower sections and supporting surfaces comprise separable members readily displaceable from a coplanar disposition to a folded or separate assembly. FIG. 4 of the drawings illustrates an arrangement wherein the base 12′ comprises a top section 48 distinct from an adjacent bottom section 50 and which may be joined in a coplanar manner by shiftable connection means such as the channel elements 52 having flanges 54 slidable within the grooves 56 in the two sections. An appropriate fence 58, functioning in the manner of the fence 28 described above, is adapted to be sandwiched between the two adjacent sections. With this construction, the two base sections 48,50 may be selectively joined and separated by manipulation of the two slidable channels 52.

Figure 5:
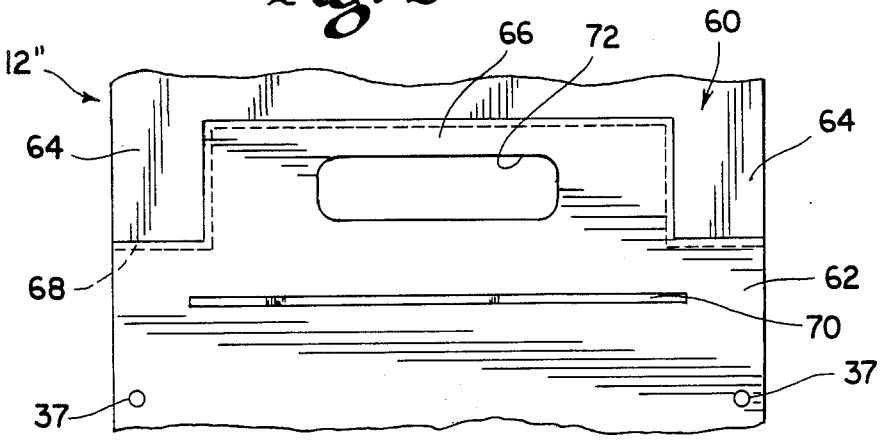

The embodiment shown in FIG. 5 of the drawings illustrates a copyholder device 12″ likewise adapted to be collapsed but which further includes ready means allowing for carrying of the device when the base is collapsed. The opposed edges of the top section 60 and bottom section 62 will be seen to be configured to provide a mating interface, With the top section 60 having a pair of laterally spaced depending arms 64 adapted to surround a handle segment 66 extending upwardly from the bottom section 62. When assembled as in the drawings, a firm fit is assured by the provision of a suitable formation on the engaging surfaces of the two sections. This formation may comprise a tongue-and-groove configuration 68 or any other construction to maintain a coplanar disposition between the top surfaces of the two base sections 60, 62. In this instance, the fence 70 is preferably affixed to the bottom section, such as shown in FIG. 5. By providing a handgrip opening 72 in the handle segment 66 the device may be conveniently carried by a user, following separation of the two sections 60, 62. In such a transport mode, the removed top section 60 may be disposed in an overlying manner atop a stack of paper disposed upon the bottom section 62 and the combined assembly further secured by any suitable means such as straps, elastic members, etc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents, which may be resorted to, fall within the scope of the invention.

What is claimed is:

1. A device for handling continuous-sheet fanfold paper comprising:

a base including an upper and lower section defining a supporting surface having a top, bottom and opposite sides, stack support means projecting upwardly from said base adjacent said bottom, a fixedly mounted fence projecting upwardly from said base intermediate said upper and lower sections, a stack of continuous sheets of fanfold paper having transverse tearlines between adjacent pairs of sheets, a plurality of said sheets defining a lower stack overlying said lower section supporting surface and supported upon said stack support means, said fence spaced from said stack support means a distance selected to closely accommodate said lower stack therebetween with said tearlines at the upper portion thereof juxtaposed said fence, and stabilizing means on said base adapted to engage the lateral portions of sheets of paper overlying said base, whereby, pairs of said sheets in said lower stack may be folded upwardly to a position overlying said upper section supporting surface above said fence with the thus displaced sheets defining an upper stack having said tearlines at the lower portion thereof engaging and supported by said fence while said tearline joining the top sheets of said lower and upper stacks overlies said fence.

2. A paper handling device according to claim 1 wherein, said base upper and lower sections comprise a rigid integral member.

3. A paper handling device according to claim 1 wherein, said base upper and lower sections comprise separable sections having opposed portions, and mating means on said opposed portions permitting of selective assembly and disassembly of said sections.

4. A paper handling device according to claim 1 wherein, said stabilizing means includes upwardly projecting pins adjacent said base sides engageable with the lateral edges of said stacks.

5. A paper handling device according to claim 3 wherein, said mating means includes tongue and groove formations on said opposed portions.

6. A paper handling device according to claim 3 wherein, said mating means includes slidable channels engageable with grooves provided within said opposed portions.

7. A paper handling device according to claim 3 including, handgrip means on one said section usable when said sections are separated to carry said device.

8. A paper handling device according to claim 1 including, brace means attached to the back of said base and shiftable to a position enabling propping of said base at a selected angle with respect to an underlying surface.

* * * * *